US007815292B2

(12) United States Patent
Enomoto et al.

(10) Patent No.: US 7,815,292 B2
(45) Date of Patent: Oct. 19, 2010

(54) LIQUID EJECTION HEAD

(75) Inventors: Katsumi Enomoto, Kanagawa (JP); Takuya Takata, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 987 days.

(21) Appl. No.: 11/444,495

(22) Filed: Jun. 1, 2006

(65) Prior Publication Data

US 2006/0274127 A1 Dec. 7, 2006

(30) Foreign Application Priority Data

Jun. 3, 2005 (JP) ..... 2005-164072

(51) Int. Cl.
*B41J 2/045* (2006.01)

(52) U.S. Cl. ..... 347/68

(58) Field of Classification Search ..... 347/68, 347/70–72; 310/369

See application file for complete search history.

(56) References Cited

U.S. PATENT DOCUMENTS 5,539,982 A * 7/1996 Hosono et al. ..... 29/890.1
6,126,273 A * 10/2000 Van Vooren et al. ..... 347/54
2003/0206218 A1* 11/2003 Miyata et al. ..... 347/70
2005/0023937 A1* 2/2005 Sashida et al. ..... 310/348

FOREIGN PATENT DOCUMENTS

JP 6-286126 A 10/1994
JP 2002-46281 A 2/2002

* cited by examiner

*Primary Examiner*—An H Do
(74) *Attorney, Agent, or Firm*—Birch, Stewart, Kolasch and Birch, LLP

(57) ABSTRACT

The liquid ejection head includes: a piezoelectric body which generates pressure for ejecting liquid; a spacer member which forms a space allowing the piezoelectric body to be displaced; and an electrical connection member which connects the piezoelectric body with a substrate having a wire, the electrical connection member being provided inside the space, wherein the following formula is satisfied: $\sigma_{min} \times L/\delta L_{min} \leqq E \leqq \sigma_{max} \times L/\delta L_{max}$, where a range from $\sigma_{min}$ through $\sigma_{max}$ represents a range of a pressing force when the piezoelectric body and the substrate is connected via the electrical connection member, L represents a thickness of the spacer member, a range from $\delta L_{min}$ through $\delta L_{max}$ represents a range of an amount of compressive deformation of the spacer member when the pressing force is applied within the range of the pressing force, and E represents a Young's modulus of the spacer member.

20 Claims, 12 Drawing Sheets

96
92
σ max
98
57
58
56
90
L − δ Lmax
δ Lmax
d1
L
h

FIG.10

| | CASE OF SPACERS AND SUBSTRATE HAVING THE SAME CHARACTERISTICS | CASE OF SPACERS AND SUBSTRATE HAVING DIFFERENT CHARACTERISTICS (YOUNG'S MODULUS OF SPACERS < YOUNG'S MODULUS OF SUBSTRATE) |
|---|---|---|
| THICKNESS OF SPACER MEMBER | 2mm | 0.1mm |
| PRESSING FORCE | 3~10MPa | 3~10MPa |
| ALLOWABLE DISTORTION OF SPACER MEMBER | 2~7.5 μm | 2~7.5 μm |
| YOUNG'S MODULUS RANGE FOR SATISFYING ABOVE | 2.7~3GPa | 133~500MPa |

LIQUID EJECTION HEAD

BACKGROUND OF THE INVENTION

1. Field of the Invention

The present invention relates to a liquid ejection head, and more particularly, to a liquid ejection head where a piezoelectric element is used as a pressure generating device for ejecting liquid.

2. Description of the Related Art

As an image forming apparatus, an inkjet printer (inkjet recording apparatus) is known which comprises an inkjet head (liquid ejection head) having an arrangement of a plurality of nozzles (liquid ejection ports) and which records images on a recording medium by ejecting ink (liquid) from the nozzles toward the recording medium while the inkjet head and the recording medium are caused to be moved relatively to each other.

An inkjet head in an inkjet printer of this kind has pressure generating units, each comprising, for example, a pressure chamber to which ink is supplied from an ink tank via an ink supply path, a piezoelectric element which is driven by an electric signal in accordance with image data, a diaphragm constituting a portion of the pressure chamber which is deformed by driving the piezoelectric element, and a nozzle which connects to a pressure chamber from which the ink inside the pressure chamber is ejected as a liquid droplet by means of the volume of the pressure chamber being decreased by the deformation of the diaphragm. In an inkjet recording printer, one image is formed on a recording medium by combining dots formed by ink ejected from the nozzles of the pressure generating units.

Therefore, in order to form an image of high quality in a stable fashion, it is necessary to arrange the pressure generating units at high density and to ensure reliable electrical connections in the wires that supply drive signals for driving the piezoelectric elements, and driving the piezoelectric elements stably, without obstruction of the drive of the piezoelectric elements.

In view of the above circumstances, for example, Japanese Patent Application Publication No. 6-286126 discloses an inkjet head. In the inkjet head, in order to increase the reliability of the hermetic sealing of ink ejection devices (piezoelectric elements), the ink ejection devices are connected electrically to terminal sections of a flexible cable, and are hermetically sealed by an adhesive layer in the gaps between the flexible cable and a flow channel substrate or a lid plate, or alternatively, the ink ejection devices are maintained in a hermetically sealed state by forming projecting sections of substantially the same height as the thickness of the ink ejection devices on either the flow channel substrate or the lid plate, in such a manner that they surround the perimeter of the ink ejection devices, and by bonding a flexible cable on top of the projecting sections by means of an adhesive layer.

Furthermore, Japanese Patent Application Publication No. 2002-46281 discloses an inkjet type recording head. In the inkjet type recording head, in order to improve the rigidity of the chamber partitions and to arrange pressure generating chambers at high density, a bonding substrate made of single crystal silicon is bonded to the piezoelectric element side of a flow channel formation substrate, via a sealing member, and an integrated circuit is formed in an integrated fashion on the region of the bonding substrate opposing the piezoelectric elements, on the same side as the bonding surface with the flow channel formation substrate. Conductive members are connected to the electrodes constituting the piezoelectric elements, thereby electrically connecting the piezoelectric elements and the integrated circuit, and furthermore, each piezoelectric element is sealed within a space demarcated by the bonding substrate and the sealing member.

However, in the technology described in Japanese Patent Application Publication No. 6-286126, since the flexible cable is supported substantially by the adhesive layer, contact between the flexible cable and the ejection devices may occur if the thickness of the adhesive layer decreases due to the bonding pressure, and hence the driving of the ejection devices is constricted and it may become difficult to perform stable ejection.

Furthermore, in the technology described in Japanese Patent Application Publication No. 2002-46281, the flow channel substrate and the bonding substrate are limited to being single crystal silicon, and hence there is no freedom of choice of the material, and furthermore, the sealing member is also limited to being an adhesive, glass, or silicon. Therefore, if the sealing member is constituted by adhesive only, the adhesive layer deforms due to the pressure applied in order to achieve sufficient bonding force, and there is a possibility that the bonding substrate may come into contact with the piezoelectric elements and may obstruct the driving of the piezoelectric elements. Furthermore, if a hard material such as glass or silicon is used for the sealing member, then it is difficult to curb the influence of variations in the thickness of the piezoelectric elements and the influence of variations in the height of the conducting members, and there is a possibility that suitable reliability may not be ensured in the connections with the integrated circuit.

SUMMARY OF THE INVENTION

The present invention has been contrived in view of the aforementioned circumstances, an object thereof being to provide a liquid ejection head which is capable of curbing the influence of height variations in the electrical connections or the influence of thermal expansion differences between them, thus improving the reliability of the connections, without obstructing the driving of a piezoelectric element.

In order to attain the aforementioned object, the present invention is directed to a liquid ejection head, comprising: a piezoelectric body which generates pressure for ejecting liquid; a spacer member which forms a space allowing the piezoelectric body to be displaced; and an electrical connection member which connects the piezoelectric body with a substrate having a wire, the electrical connection member being provided inside the space, wherein the following formula is satisfied: $\sigma_{min} \times L/\delta L_{min} \leqq E \leqq \sigma_{max} \times L/\delta L_{max}$, where a range from $\sigma_{min}$ through $\sigma_{max}$ represents a range of a pressing force when the piezoelectric body and the substrate is connected via the electrical connection member, L represents a thickness of the spacer member, a range from $\delta L_{min}$ through $\delta L_{max}$ represents a range of an amount of compressive deformation of the spacer member when the pressing force is applied within the range of the pressing force, and E represents a Young's modulus of the spacer member.

According to this aspect of the present invention, a space which prevents constriction of the deformation of the piezoelectric body can be ensured, and furthermore, thickness variations in the piezoelectric body and the electrical connection member can be compensated and reliable bonding can be achieved.

Preferably, $\sigma_{min}$ is 0.5 MPa, $\sigma_{max}$ is 50 MPa, $\delta L_{min}$ is 1 μm, and $\delta L_{max}$ is 15 μm.

According to this aspect of the present invention, the space is ensured more reliably and reliable connection and bonding can be achieved.

Preferably, the spacer member is made from a resin material.

According to this aspect of the present invention, compared with an inorganic material, the amount of compression deformation of the spacer member can increase and a compensable range of the thickness variations can be larger.

Preferably, the spacer member is made from a rubber material.

According to this aspect of the present invention, a compensable range of the thickness variations can be larger.

Preferably, the spacer member and the substrate are made from a same material.

According to this aspect of the present invention, the spacer member and the substrate can be integrally formed, and in such a case, the number of the components can decrease and the costs can be reduced.

Alternatively, it is also preferable that: the spacer member and the substrate are made of different materials; and the Young's modulus of the spacer member is lower than a Young's modulus of the substrate.

According to this aspect of the present invention, height variations in the piezoelectric body and the electrical connection member can be compensated by deformation of the spacer member, and hence reliable connections can be achieved.

Preferably, the liquid ejection head further comprises an electrical wire which supplies a drive signal for driving the piezoelectric body, the electrical wire being formed so as to rise upward substantially perpendicularly to a surface on which the piezoelectric body is formed.

According to this aspect of the present invention, it is possible to achieve a high density arrangement of liquid ejection ports in a liquid ejection head in which liquid ejection ports are arranged in a two-dimensional matrix configuration.

As described above, according to the present invention, a space which prevents constriction of the deformation of the piezoelectric body can be ensured, thickness variations in the piezoelectric body and the electrical connection member can be compensated, and reliable bonding can be achieved.

BRIEF DESCRIPTION OF THE DRAWINGS

The nature of this invention, as well as other objects and benefits thereof, will be explained in the following with reference to the accompanying drawings, wherein:

FIGS. 8A and 8B are illustrative diagrams showing a case where the substrate and spacer members are bonded at a minimum pressing force, $\sigma_{min}$; in which FIG. 8A shows a state before pressing and FIG. 8B shows a state after pressing;

FIGS. 9A and 9B are illustrative diagrams showing a case where the substrate and spacer members are bonded at a maximum pressing force, $\sigma_{max}$; in which FIG. 9A shows a state before pressing and FIG. 9B shows a state after pressing;

FIG. 10 is an illustrative diagram showing the range of the Young's modulus of the spacer members;

DETAILED DESCRIPTION OF THE PREFERRED EMBODIMENTS

Figure 1:
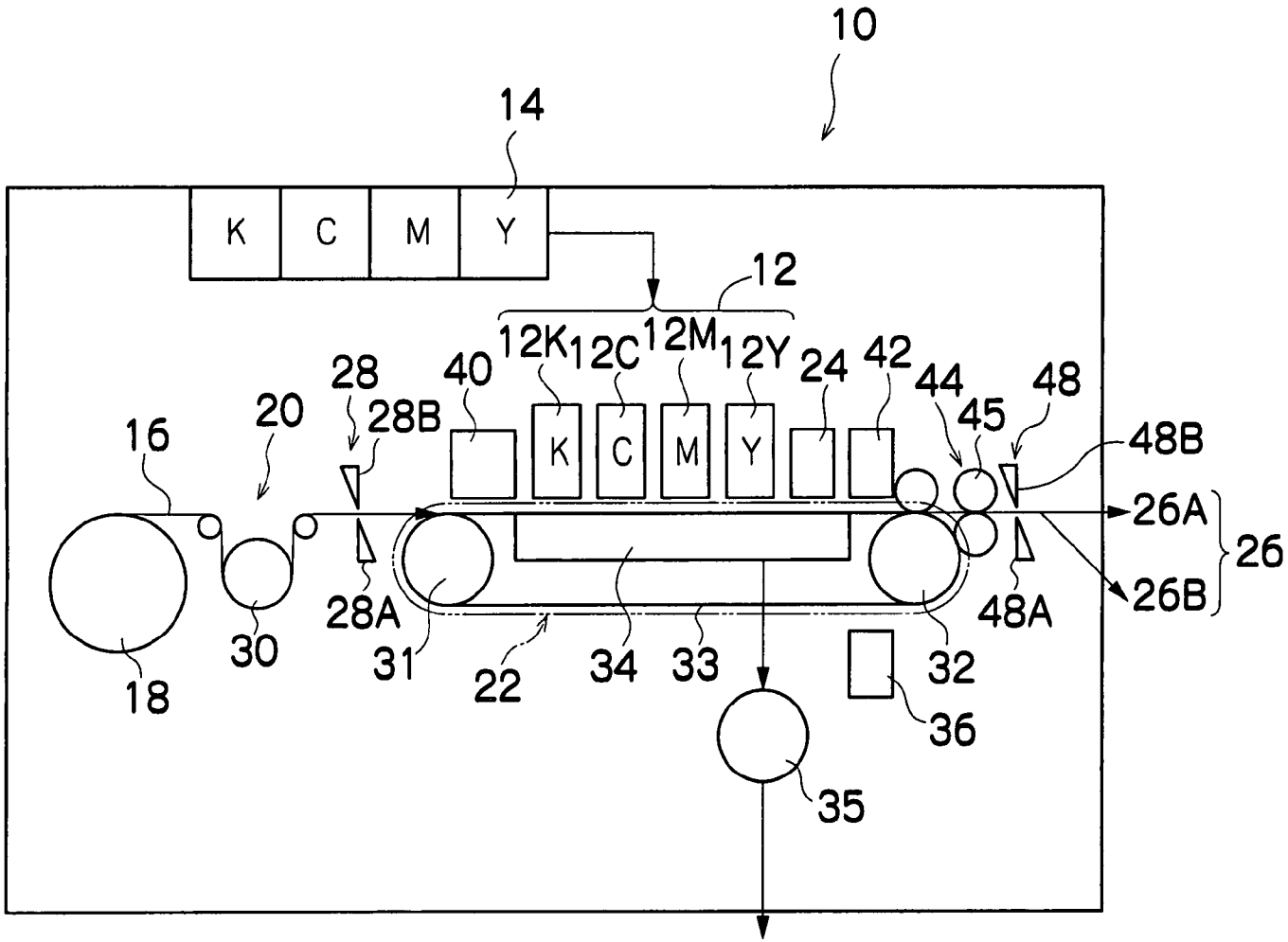
FIG. 1 is a general schematic drawing showing an approximate view of one embodiment of an inkjet recording apparatus forming an image recording apparatus comprising a liquid ejection head (print head) relating to the present invention.

FIG. 1 is a general schematic drawing showing an approximate view of one embodiment of an inkjet recording apparatus forming an image recording apparatus.

As shown in FIG. 1, the inkjet recording apparatus 10 comprises: a printing unit 12 having a plurality of print heads (liquid ejection heads) 12K, 12C, 12M, and 12Y for ink colors of black (K), cyan (C), magenta (M), and yellow (Y), respectively; an ink storing and loading unit 14 for storing inks of K, C, M and Y to be supplied to the print heads 12K, 12C, 12M, and 12Y; a paper supply unit 18 for supplying recording paper 16; a decurling unit 20 for removing curl in the recording paper 16; a suction belt conveyance unit 22 disposed facing the nozzle face (ink-droplet ejection face) of the print unit 12, for conveying the recording paper 16 while the recording paper 16 is kept flat; a print determination unit 24 for reading the printed result produced by the printing unit 12; and a paper output unit 26 for outputting image-printed recording paper (printed matter) to the exterior.

In FIG. 1, a magazine for roll paper (continuous paper) is shown as an embodiment of the paper supply unit 18; however, more magazines for papers different in characteristics such as paper width and quality may be jointly provided. Moreover, papers may be supplied with cassettes that contain cut papers loaded in layers and that are used jointly or in lieu of the magazine for roll paper.

In the case of a configuration in which roll paper is used, a cutter 28 is provided as shown in FIG. 1, and the roll paper is cut to a desired size by the cutter 28. The cutter 28 has a stationary blade 28A whose length is not less than the width of the conveyor pathway of the recording paper 16, and a round blade 28B which moves along the stationary blade 28A. The stationary blade 28A is disposed on the reverse side opposing from the printed surface of the recording paper 16, and the round blade 28B is disposed on the printed surface side across the conveyance path from the reverse side. When cut paper is used, the cutter 28 is not required.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a plane (flat plane).

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1. The suction chamber 34 provides suction with a fan 35 to generate a negative pressure, and the recording paper 16 is held on the belt 33 by the suction.

The belt 33 is driven in the clockwise direction in FIG. 1 by the motive force of a motor (not shown) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, embodiments thereof include a configuration in which the belt 33 is nipped with cleaning rollers such as a brush roller and a water absorbent roller, an air blow configuration in which clean air is blown onto the belt 33, or a combination of these. In the case of the configuration in which the belt 33 is nipped with the cleaning rollers, it is preferable to make the line velocity of the cleaning rollers different from that of the belt 33 to improve the cleaning effect.

The inkjet recording apparatus 10 can comprise a roller nip conveyance mechanism in which the recording paper 16 is pinched and conveyed with nip rollers, instead of the suction belt conveyance unit 22. However, there is a possibility in the roller nip conveyance mechanism that the print tends to be smeared when the printing area is conveyed by the roller nip action because the nip roller makes contact with the printed surface of the paper immediately after printing. Therefore, the suction belt conveyance, in which nothing comes into contact with the image surface in the printing area, is preferable.

A heating fan 40 is disposed before the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

Figure 2:
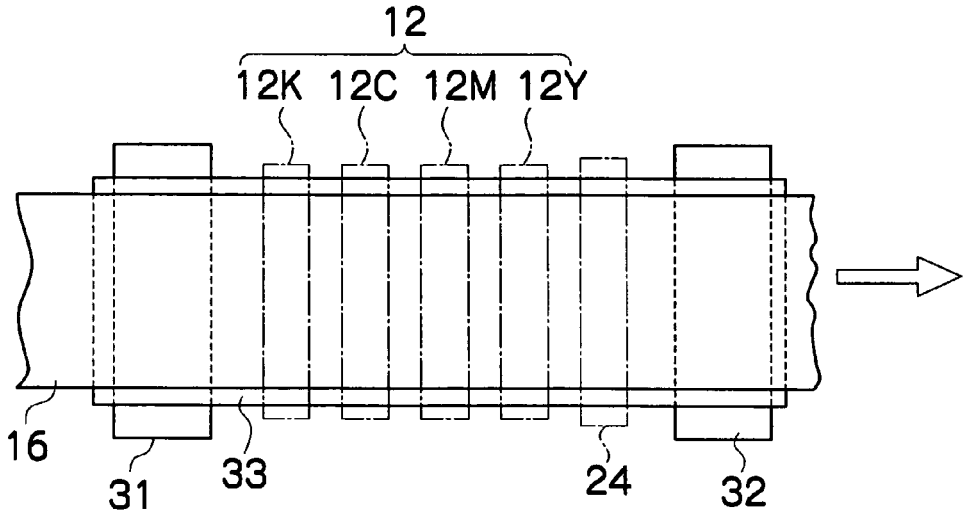
FIG. 2 is a plan view of the principal part of the peripheral area of a print unit in the inkjet recording apparatus shown in FIG. 1.

The print unit 12 is a so-called "full line head" in which a line head having a length corresponding to the maximum paper width is arranged in a direction (main scanning direction) that is perpendicular to a paper conveyance direction (sub-scanning direction) (see FIG. 2).

As shown in FIG. 2, each of the print heads 12K, 12C, 12M, and 12Y is constituted by a line head, in which a plurality of ink ejection ports (nozzles) are arranged in accordance with a length that exceeds at least one side of the maximum-size recording paper 16 intended for use in the inkjet recording apparatus 10.

The print heads 12K, 12C, 12M, and 12Y for respective color inks are arranged in the order of black (K), cyan (C), magenta (M), and yellow (Y) from the upstream side (left side in FIG. 1), in the conveyance direction of the recording paper 16 (paper conveyance direction). A color image can be formed on the recording paper 16 by ejecting the inks from the print heads 12K, 12C, 12M, and 12Y, respectively, onto the recording paper 16 while the recording paper 16 is conveyed.

The print unit 12, in which the full-line heads covering the entire width of the paper are thus provided for the respective ink colors, can record an image over the entire surface of the recording paper 16 by performing the action of moving the recording paper 16 and the print unit 12 relative to each other in the paper conveyance direction (sub-scanning direction) just once (in other words, by means of a single sub-scan). Higher-speed printing is thereby made possible and productivity can be improved in comparison with a shuttle type head configuration in which a print head moves back and forth in the direction (main scanning direction) that is perpendicular to paper conveyance direction.

Here, the terms "main scanning direction" and "sub-scanning direction" are used in the following senses. More specifically, in a full-line head comprising nozzle rows that have a length corresponding to the entire width of the recording paper, "main scanning" is defined as printing one line (a line formed of a row of dots, or a line formed of a plurality of rows of dots) in the breadthways direction of the recording paper (the direction perpendicular to the conveyance direction of the recording paper) by driving the nozzles in one of the following ways: (1) simultaneously driving all the nozzles; (2) sequentially driving the nozzles from one side toward the other; and (3) dividing the nozzles into blocks and sequentially driving the blocks of the nozzles from one side toward the other. The direction indicated by one line recorded by a main scanning action (the lengthwise direction of the band-shaped region thus recorded) is called the "main scanning direction".

On the other hand, "sub-scanning" is defined as to repeatedly perform printing of one line (a line formed of a row of dots, or a line formed of a plurality of rows of dots) formed by the main scanning action, while the full-line head and the recording paper is moved relatively to each other. The direction in which sub-scanning is performed is called the sub-scanning direction. Consequently, the conveyance direction of the recording paper is the sub-scanning direction and the direction perpendicular to same is called the main scanning direction.

Although the configuration with the KCMY four standard colors is described in the present embodiment, combinations of the ink colors and the number of colors are not limited to those. Light inks or dark inks can be added as required. For example, a configuration is possible in which print heads for ejecting light-colored inks such as light cyan and light magenta are added. Furthermore, there are no particular restrictions of the sequence in which the heads of respective colors are arranged.

As shown in FIG. 1, the ink storing and loading unit 14 has ink tanks for storing the inks of the colors corresponding to the respective print heads 12K, 12C, 12M, and 12Y, and the respective tanks are connected to the print heads 12K, 12C, 12M, and 12Y by means of channels (not shown). The ink storing and loading unit 14 has a warning device (for example, a display device or an alarm sound generator) for warning when the remaining amount of any ink is low, and has a mechanism for preventing loading errors among the colors.

The print determination unit 24 has an image sensor (line sensor) for capturing an image of the ink-droplet deposition result of the printing unit 12, and functions as a device to check for ejection defects such as clogs of the nozzles in the printing unit 12 on the basis of the ink-droplet deposition results evaluated by the image sensor.

The print determination unit 24 of the present embodiment is configured with at least a line sensor having rows of photoelectric transducing elements with a width that is greater than the ink-droplet ejection width (image recording width) of the print heads 12K, 12C, 12M, and 12Y. This line sensor has a color separation line CCD sensor including a red (R) sensor row composed of photoelectric transducing elements (pixels) which each are provided with a red filter (R filter) and are arranged in a line, a green (G) sensor row with green filters (G filters), and a blue (B) sensor row with blue filters (B filters). Instead of a line sensor, it is possible to use an area sensor composed of photoelectric transducing elements which are arranged two-dimensionally.

The print determination unit 24 reads a test pattern image printed by the print heads 12K, 12C, 12M, and 12Y for the respective colors, and the ejection of each head is determined. The ejection determination includes the presence of the ejection, measurement of the dot size, and measurement of the dot deposition position.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The image to be printed (i.e., the result of printing the object image) and the test print image are preferably outputted separately. In the inkjet recording apparatus 10, a sorting device (not shown) is provided for switching the outputting pathways in order to sort the printed matter with the image to be printed and the printed matter with the test print, and to send them to paper output units 26A and 26B, respectively. When the image to be printed and the test print image are simultaneously formed in parallel on the same large sheet of paper, the test print portion is cut and separated by a cutter (second cutter) 48. The cutter 48 is disposed directly in front of the paper output unit 26, and is used for cutting the test print image portion from the image portion to be printed when a test print has been performed in the blank portion of a sheet with the target print. The structure of the cutter 48 is the same as the first cutter 28 described above, and has a stationary blade 48A and a round blade 48B.

Although not shown in the drawings, the paper output unit 26A for the images to be printed is provided with a sorter for collecting prints according to print orders.

Figure 3:
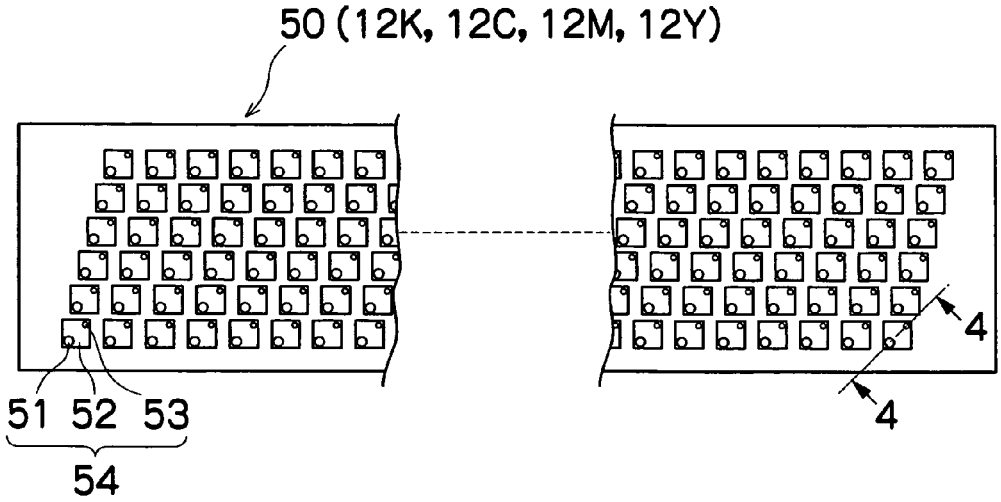
FIG. 3 is a plan perspective diagram showing an embodiment of the structure of a print head.

Next, the arrangement of nozzles (liquid ejection ports) in the print head (liquid ejection head) is described below. The print heads 12K, 12C, 12M and 12Y provided for the respective ink colors have the same structure, and the reference numeral 50 represents a print head which is a representative embodiment of these print heads. FIG. 3 shows a plan view perspective diagram of the print head 50.

As shown in FIG. 3, the print head 50 according to the present embodiment achieves a high density arrangement of nozzles 51 by using a two-dimensional staggered matrix array of pressure chamber units 54, each constituted by a nozzle for ejecting ink as ink droplets, a pressure chamber 52 for applying pressure to the ink in order to eject ink, and an ink supply port 53 for supplying ink to the pressure chamber 52 from a common flow channel (not shown in FIG. 3).

There are no particular limitations on the size of the nozzle arrangement in a print head 50 of this kind, but as one embodiment, 2400 nozzles per inch (npi) can be achieved by arranging nozzles 51 in 48 lateral rows (21 mm) and 600 vertical columns (305 mm).

In the embodiment shown in FIG. 3, the pressure chambers 52 each have an approximately square planar shape when viewed from above, but the planar shape of each of the pressure chambers 52 is not limited to a square shape. As shown in FIG. 3, a nozzle 51 is formed at one end of the diagonal of each pressure chamber 52, and an ink supply port 53 is provided at the other end thereof.

Furthermore, although not shown in the drawings, one long full line head may be constituted by combining a plurality of short heads arranged in a two-dimensional staggered array, each short head having pressure chamber units similar to that in FIG. 3 arranged in a two-dimensional matrix configuration, in such a manner that the combined length of this plurality of short heads corresponds to the full width of the print medium.

Figure 4:
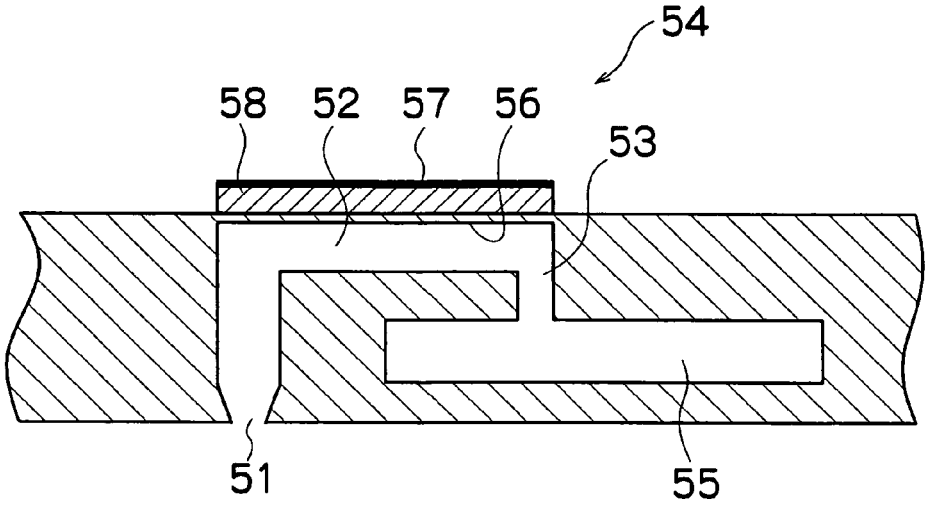
FIG. 4 is a cross-sectional diagram of a pressure chamber unit along line 4-4 in FIG. 3.

Furthermore, FIG. 4 shows a cross-sectional diagram along line 4-4 in FIG. 3.

As shown in FIG. 4, each pressure chamber unit 54 includes a pressure chamber 52 which is connected to a nozzle 51 that ejects ink, a common flow chamber 55 for supplying ink via a supply port 53 is connected to the pressure chamber 52, and one surface of the pressure chamber 52 (the ceiling in the diagram) is constituted by a diaphragm 56. A piezoelectric body 58 which applies pressure to the diaphragm 56 and deforms the diaphragm 56 is bonded to the upper part of the diaphragm, and an individual electrode 57 is formed on the upper surface of the piezoelectric body 58. Furthermore, the diaphragm 56 also serves as a common electrode.

The piezoelectric body 58 forms a piezoelectric element which is sandwiched between the common electrode (diaphragm 56) and the individual electrode 57, and it deforms when a drive voltage is applied to these two electrodes 56 and 57. The diaphragm 56 is pressed by the deformation of the piezoelectric body (piezoelectric element) 58, in such a manner that the volume of the pressure chamber 52 is reduced and ink is ejected from the nozzle 51. When the voltage applied between the two electrodes 56 and 57 is released, the piezoelectric body 58 returns to its original position, the volume of the pressure chamber 52 returns to its original size, and new ink is supplied into the pressure chamber 52 from the common liquid channel 55 via the supply port 53.

Figure 5:
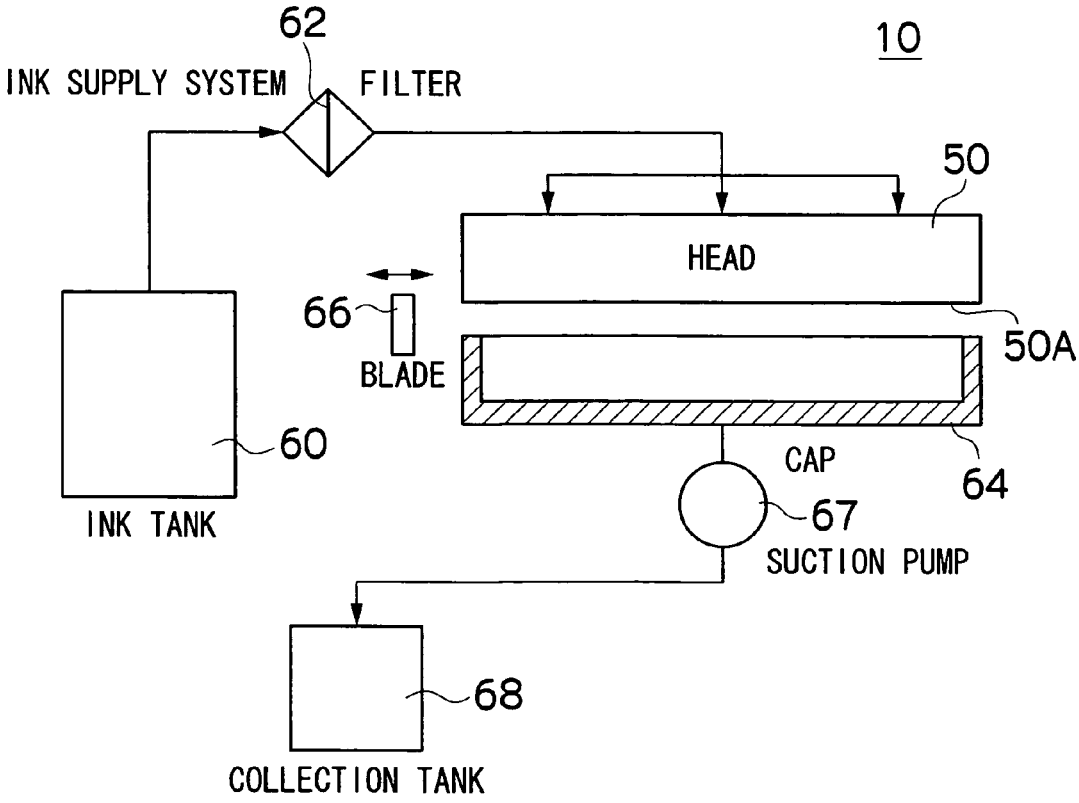
FIG. 5 is a schematic drawing showing the composition of an ink supply system in the inkjet recording apparatus according to an embodiment.

FIG. 5 is a schematic drawing showing the configuration of the ink supply system in the inkjet recording apparatus 10. The ink tank 60 is a base tank that supplies ink to the print head 50 and is set in the ink storing and loading unit 14, which is described above with reference to FIG. 1. The aspects of the ink tank 60 include a refillable type and a cartridge type: when the remaining amount of ink is low, the ink tank 60 of the refillable type is filled with ink through a filling port (not shown) and the ink tank 60 of the cartridge type is replaced with a new one. In order to change the ink type in accordance with the intended application, the cartridge type is suitable, and it is preferable to represent the ink type information with a bar code or the like on the cartridge, and to perform ejection control in accordance with the ink type. The ink tank 60 in FIG. 5 is equivalent to the ink storing and loading unit 14 in FIG. 1 described above.

A filter 62 for removing foreign matters and bubbles is disposed in the middle of the channel connecting the ink tank 60 and the print head 50 as shown in FIG. 5. The filter mesh size in the filter 62 is preferably equivalent to or less than the diameter of the nozzle of the print head 50 and commonly about 20 μm.

Although not shown in FIG. 5, it is preferable to provide a sub-tank integrally to the print head 50 or nearby the print head 50. The sub-tank has a damper function for preventing variation in the internal pressure of the head and a function for improving refilling of the print head.

The inkjet recording apparatus 10 is also provided with a cap 64 as a device to prevent the nozzles from drying out or to prevent an increase in the ink viscosity in the vicinity of the nozzles 51, and a cleaning blade 66 as a device to clean the nozzle face 50A.

A maintenance unit including the cap 64 and the cleaning blade 66 can be relatively moved with respect to the print head 50 by a movement mechanism (not shown), and is moved from a predetermined holding position to a maintenance position below the print head 50 as required.

The cap 64 is displaced upward and downward in a relative fashion with respect to the print head 50 by an elevator mechanism (not shown). When the power of the inkjet recording apparatus 10 is switched off or when the apparatus is in a standby state for printing, the elevator mechanism raises the cap 64 to a predetermined elevated position so as to come into close contact with the print head 50, and the nozzle region of the nozzle surface 50A is thereby covered by the cap 64.

The cleaning blade 66 is composed of rubber or another elastic member, and can slide on the ink ejection surface (nozzle surface 50A) of the print head 50 by means of a blade movement mechanism (not shown). If there are ink droplets or foreign matter adhering to the nozzle surface 50A, then the nozzle surface 50A is wiped by causing the cleaning blade 66 to slide over the nozzle surface 50A, thereby cleaning same.

During printing or during standby, if the use frequency of a particular nozzle 51 has declined and the ink viscosity in the vicinity of the nozzle 51 has increased, then a preliminary ejection is performed toward the cap 64, in order to remove the ink that has degraded as a result of increasing in viscosity.

Also, when bubbles have become intermixed in the ink inside the print head 50 (the ink inside the pressure chambers 52), the cap 64 is placed on the print head 50, ink (ink in which bubbles have become intermixed) inside the pressure chambers 52 is removed by suction with a suction pump 67, and the ink removed by the suction is sent to a collection tank 68. This suction operation is also carried out in order to suction and remove degraded ink which has hardened due to increasing in viscosity when ink is loaded into the print head for the first time and/or when the print head starts to be used after having been out of use for a long period of time.

In other words, when a state in which ink is not ejected from the print head 50 continues for a certain amount of time or longer, the ink solvent in the vicinity of the nozzles 51 evaporates and the ink viscosity increases. In such a state, ink can no longer be ejected from the nozzles 51 even if the pressure generating devices (not shown, but described hereinafter) for driving ejection are operated. Therefore, before a state of this kind is reached (while the ink is in a range of viscosity which allows ink to be ejected by means of operation of the pressure generating devices), a "preliminary ejection" is carried out, whereby the pressure generating devices are operated and the ink in the vicinity of the nozzles which is of raised viscosity is ejected toward the ink receptacle. Furthermore, after cleaning away soiling on the surface of the nozzle surface 50A by means of a wiper, such as a cleaning blade 66 provided as a cleaning device for the nozzle surface 50A, a preliminary ejection is also carried out in order to prevent infiltration of foreign matter into the nozzles 51 due to the rubbing action of the wiper. The preliminary ejection is also referred to as "dummy ejection", "purge", "liquid ejection", and so on.

When bubbles have become intermixed into a nozzle 51 or a pressure chamber 52, or when the ink viscosity inside the nozzle 51 has increased over a certain level, ink can no longer be ejected by means of a preliminary ejection, and hence a suctioning action is carried out as follows.

More specifically, when bubbles have become intermixed into the ink inside the nozzles 51 and the pressure chambers 52, or when the ink viscosity inside the nozzle 51 has increased over a certain level, ink can no longer be ejected from the nozzles 51 even if the pressure generating devices are operated. In a case of this kind, a cap 64 is placed on the nozzle surface 50A of the print head 50, and the ink containing air bubbles or the ink of increased viscosity inside the pressure chambers 52 is suctioned by a pump 67.

However, since this suction action is performed with respect to all the ink in the pressure chambers 52, the amount of ink consumption is considerable. Therefore, a preferred example is one in which a preliminary discharge is performed when the increase in the viscosity of the ink is small. The cap 64 shown in FIG. 5 functions as a suctioning device and it may also function as an ink receptacle for preliminary ejection.

Moreover, desirably, a composition is adopted in which the inside of the cap 64 is divided by means of partitions into a plurality of areas corresponding to the nozzle rows and suction can be performed selectively in each of the demarcated areas, by means of a selector, or the like.

Figure 6:
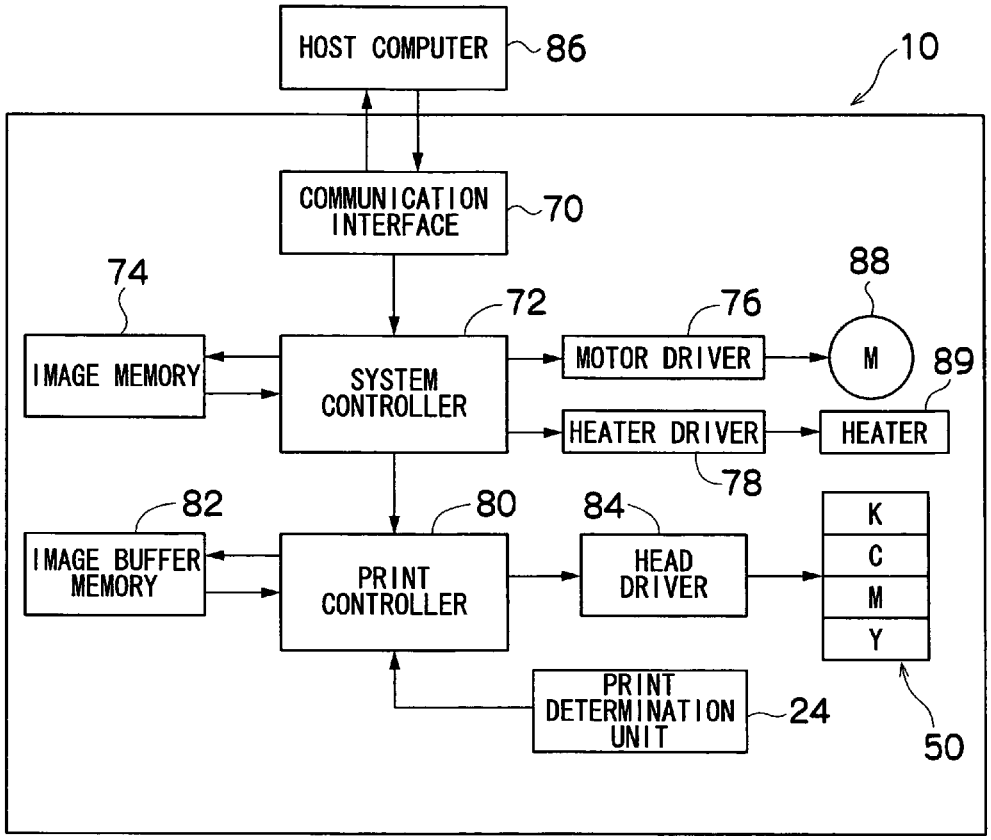
FIG. 6 is a partial block diagram showing the system composition of an inkjet recording apparatus according to an embodiment.

FIG. 6 is a principal block diagram showing the system configuration of the inkjet recording apparatus 10. The inkjet recording apparatus 10 comprises a communication interface 70, a system controller 72, an image memory 74, a motor driver 76, a heater driver 78, a print controller 80, an image buffer memory 82, a head driver 84, and the like.

The communication interface 70 is an interface unit for receiving image data sent from a host computer 86. A serial interface such as USB, IEEE1394, Ethernet, wireless network, or a parallel interface such as a Centronics interface may be used as the communication interface 70. A buffer memory (not shown) may be mounted in this portion in order to increase the communication speed. The image data sent from the host computer 86 is received by the inkjet recording apparatus 10 through the communication interface 70, and is temporarily stored in the image memory 74. The image memory 74 is a storage device for temporarily storing images inputted through the communication interface 70, and data is written and read to and from the image memory 74 through the system controller 72. The image memory 74 is not limited to a memory composed of semiconductor elements, and a hard disk drive or another magnetic medium may be used.

The system controller 72 is a control unit for controlling the various sections, such as the communication interface 70, the image memory 74, the motor driver 76, the heater driver 78, and the like. The system controller 72 is constituted by a central processing unit (CPU) and peripheral circuits thereof, and the like. The system controller 72 controls communications with the host computer 86, controls reading and writing from and to the image memory 74, and generates a control signal for controlling the motor 88 of the conveyance system and the heater 89.

The motor driver (drive circuit) 76 is a driver which drives the motor 88 in accordance with commands from the system controller 72. The heater driver (drive circuit) 78 is a driver which drives the heater 89 of the post-drying unit 42 or the like in accordance with commands from the system controller 72.

The print controller 80 has a signal processing function for performing various tasks, compensations, and other types of processing for generating print control signals on the basis of the image data stored in the image memory 74 in accordance with commands from the system controller 72, and supplies the generated print control signals (print data) to the head driver 84. Required signal processing is carried out in the print controller 80, and the ejection amount and the ejection timing of the ink droplets from the respective print heads 50 are controlled via the head driver 84, on the basis of the print data. By this means, prescribed dot size and dot positions can be achieved.

The print controller 80 is provided with the image buffer memory 82; and image data, parameters, and other data are temporarily stored in the image buffer memory 82 when image data is processed in the print controller 80. The embodiment shown in FIG. 6 is one in which the image buffer memory 82 accompanies the print controller 80; however, the image memory 74 may also serve as the image buffer memory 82. Also possible is an embodiment in which the print controller 80 and the system controller 72 are integrated to form a single processor.

The head driver 84 drives the pressure generating devices of the print heads 50 on the basis of print data supplied by the print controller 80. The head driver 84 may include a feedback control system for keeping drive conditions for the print heads constant.

The print determination unit 24 is a block that includes the line sensor (not shown) as described above with reference to FIG. 1, reads the image printed on the recording paper 16, determines the print conditions (presence of the ejection, variation in the dot formation, and the like) by performing required signal processing, or the like, and provides the print controller 80 with the determination results of the print conditions.

According to requirements, the print controller 80 makes various corrections with respect to the print head 50 on the basis of information obtained from the print determination unit 24.

Figure 7:
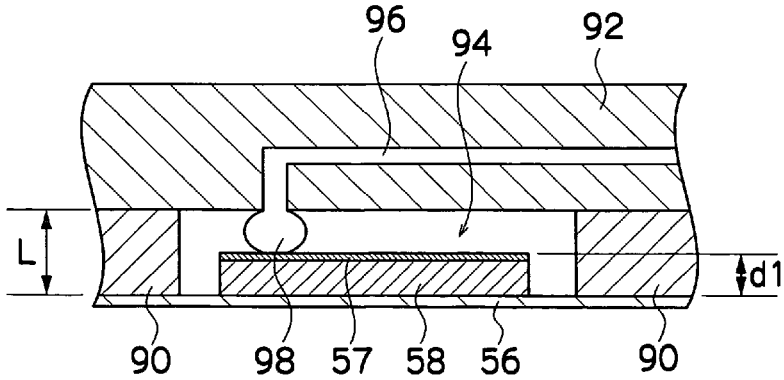
FIG. 7 is a cross-sectional diagram showing an enlarged view of an electrical connection section in the print head according to an embodiment.

FIG. 7 shows a situation of the electrical connection of a wire to a piezoelectric element, which is a characteristic feature of the present embodiment.

FIG. 7 shows the portion above the diaphragm 56 of the pressure chamber unit 54 shown in FIG. 4, in particular.

As shown in FIG. 7, a spacer member 90 is formed on top of the diaphragm 56 so as to surround the piezoelectric body 58. The height (thickness) L of the spacer member 90 is set to be higher than the height d1 of the individual electrode 57 formed over the piezoelectric body 58. When a substrate 92 is bonded to this structure, a space 94 which hermetically seals the perimeter of the piezoelectric body 58 is formed by the spacer member 90 and the substrate 92. By forming a space 94 of this kind, it is possible to drive the piezoelectric body 58 without constriction when the piezoelectric body 58 is driven in a distortion vibration mode (d31 mode).

Furthermore, the individual electrode 57 formed on the piezoelectric body 58 is electrically connected to a wire 96 formed in the substrate 92, by means of an electrical connection member 98. For the electrical connection member 98, the member which has fluidity and which does not transmit force even when it is pressurized can be used. Hence, the solder and conductive adhesive may be used, for example.

Furthermore, for the spacer member 90, it is suitable to use a soft material having insulating properties, such as a resin material, rubber material, or the like. Desirably, the height L of the spacer member 90 is set to approximately 50 μm to 100 μm, for example, in order to ensure sufficient clearance of the space 94 between the piezoelectric body 58 and the substrate 92, and the distance between the individual electrode 57 and the substrate 92 is set to approximately 30 μm to 50 μm.

A soft material is used for the spacer member 90 in order that the spacer member 90 is able to compensate (to balance) height variations in the piezoelectric bodies 58 and electrical connection members 98, and the like, during connection, by deformation of the spacer member 90, when the individual electrodes 57 are connected to the electrical connection members 98 and the substrate 92 is bonded to the spacer member 90. Here, desirably, a spacer member 90 having a Young's modulus in the range of 150 MPa to 3 GPa is used.

Figure 8B:
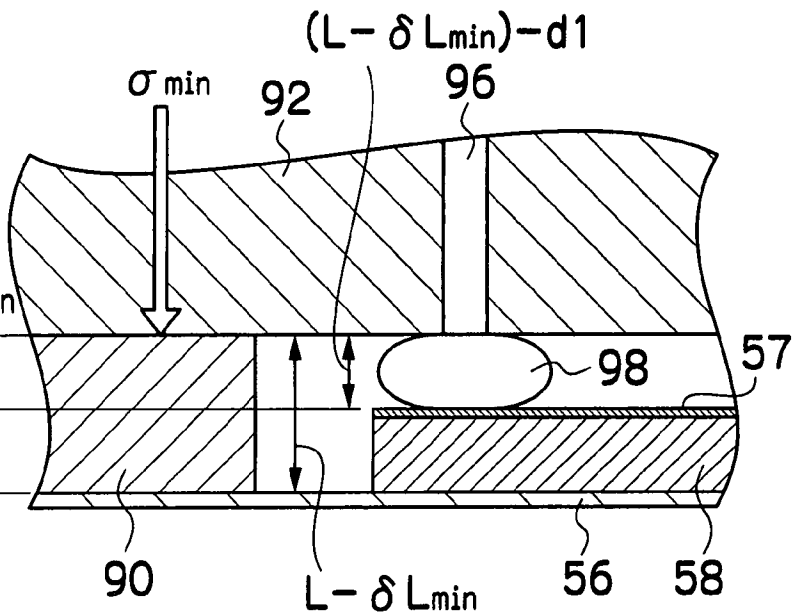
Figure 8A:
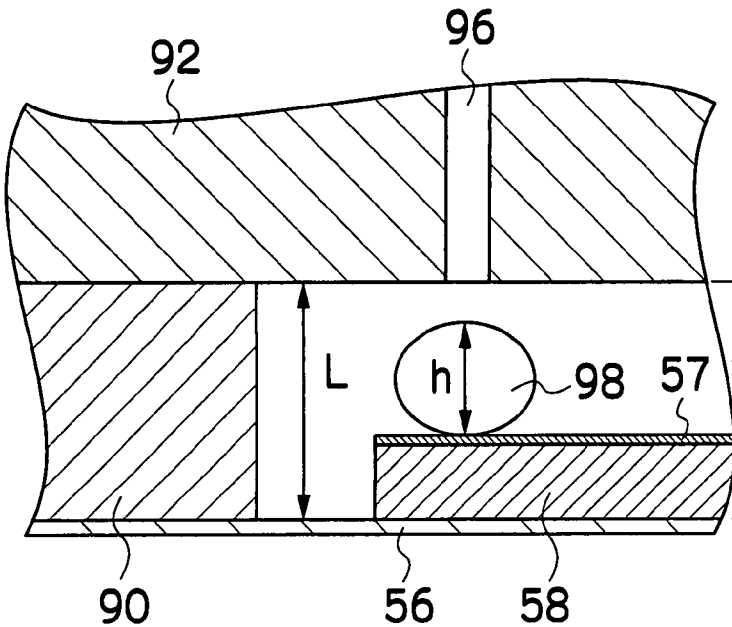

FIGS. 8A and 8B show a case where a substrate 92 and a spacer member 90 are bonded at a minimum pressing force $\sigma_{min}$. In FIG. 8A shows a state before pressing and FIG. 8B shows a state after the pressing. As shown in FIG. 8A, before pressing, the height (thickness) of the spacer member 90 is L, the height (thickness) of the electrical connection member 98 is h, and the height (thickness) of the piezoelectric body 58 is d1.

After pressing at a minimum pressing force of $\sigma_{min}$, as shown in FIG. 8B, the spacer member 90 is distorted by $\delta L_{min}$. In this case, the height of the spacer member 90 becomes "$L-\delta L_{min}$". Therefore, the distance between the piezoelectric body 58 and the substrate 92 becomes "$(L-\delta L_{min})-d1$", and if this is smaller than the height (thickness) h of the electrical connection member 98 before pressing, then the electrical connection member 98 is crushed by the pressing force and the wire 96 and the electrical connection member 98 can be connected together.

In other words, the conditions of the minimum pressing force $\sigma_{min}$ required to crush the electrical connection member 98 in the height h direction and make it become electrically connected to the wire 96, is given by the following formula: $h \geqq (L-\delta L_{min})-d1$.

Figures 9A, 9B:
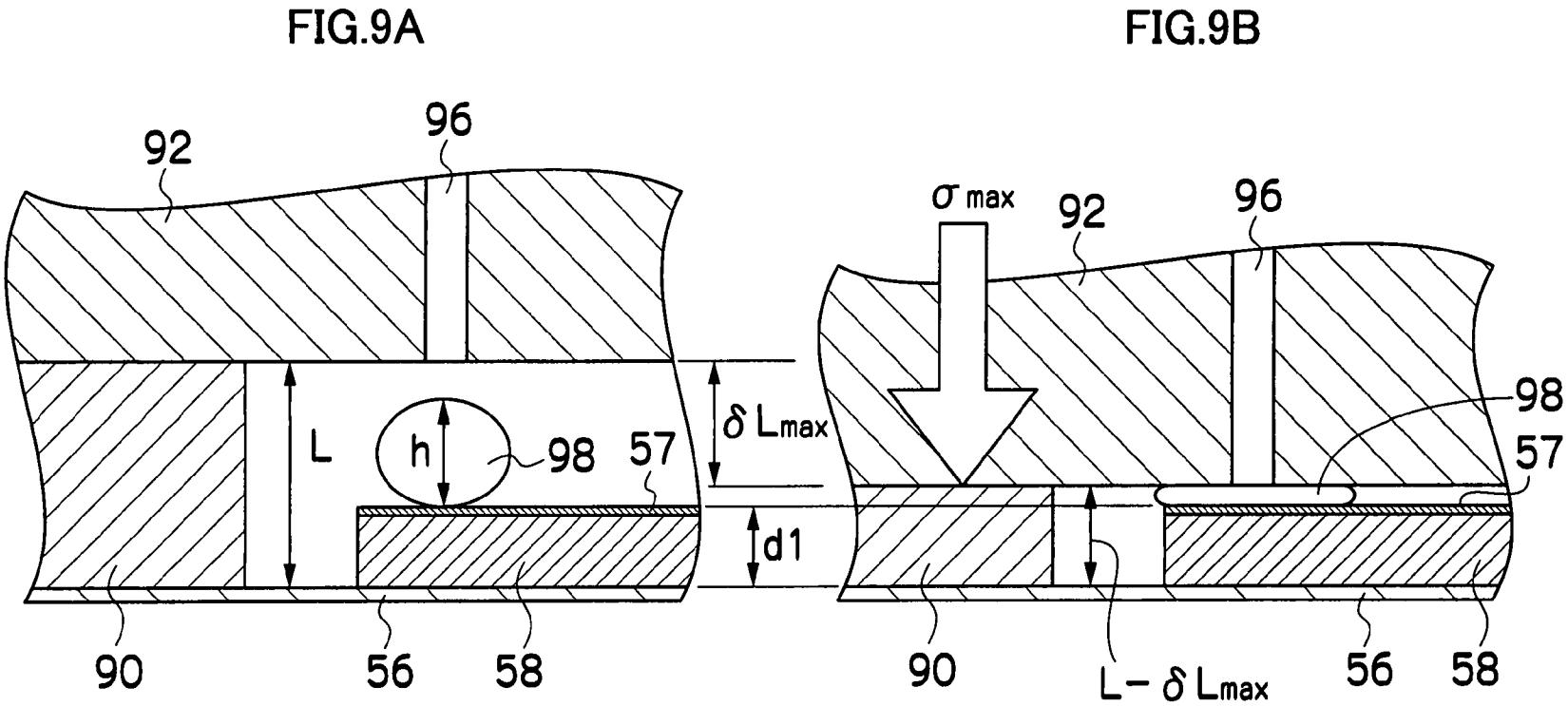

Furthermore, FIGS. 9A and 9B show a case where a substrate 92 and a spacer member 90 are bonded at a maximum applied pressure $\sigma_{max}$. FIG. 9A shows a state before pressing and FIG. 9B shows a state after pressing. Similarly to FIG. 8A, before pressing, the height (thickness) of the spacer member 90 is L, the height (thickness) of the electrical connection member 98 is h, and the height (thickness) of the piezoelectric body 58 is d1.

After pressing at a maximum pressing force of $\sigma_{max}$, as shown in FIG. 9B, the spacer member 90 is distorted by $\delta L_{max}$. In this case, the height of the spacer member 90 becomes "$L-\delta L_{max}$". Consequently, if the height of this spacer member 90, "$L-\delta L_{max}$", is not greater than the height d1 of the piezoelectric body 58, then the substrate 92 makes contact with the piezoelectric body 58 and hence constricts the piezoelectric body 58.

Therefore, the conditions of the maximum pressing force required to prevent constriction of the deformation of the piezoelectric body 58 even if the spacer member 90 is deformed by a maximum amount, is given by the following formula: $L-\delta L_{max}>d1$.

This is described in more detail below.

Here, the total height variation of the piezoelectric body 58, including variation in the thickness of the piezoelectric body 58 (and variation in the height of a bump (bump contact) if the electrical connection bump is formed on each individual electrode 57), is considered to be approximately ±5 μm. Of this, the variation of the thickness of the piezoelectric body 58 is approximately ±1 μm to ±3 μm, and that of the bumps is ±1 μm to ±3 μm.

Desirably, in order to be able to compensate this variation, the spacer member 90 distorts by, at a minimum, approximately the variation component of the piezoelectric body 58, in other words, by approximately 1 μm to 3 μm, due to the pressing action during adhesion and electrical connection. In this case, the height variation of each bump is compensated by the deformation of the bump. Hence, desirably, each bump is made of a readily deformable metal, such as gold.

Furthermore, in order to ensure the clearance (20 μm) even when the spacer member 90 is distorted by the maximum pressing force due to the pressing action during adhesion and electrical connection, it is necessary for the amount of distortion of the spacer member 90 to be 10 μm or less. Furthermore, the pressing force during adhesion is approximately 3 MPa to 10 MPa, for example, and normally, a pressure force in the range of 0.5 MPa to 50 MPa is considered suitable for general adhesion processes.

Here, a case in which the pressing force is 3 MPa, for example, and the substrate 92 and the spacer member 90 are made of the same material and have a total thickness of 2 mm, is considered. In this case, in order to generate a distortion of approximately 2 μm so as to compensate the variation in the thickness of the piezoelectric body 58, it is required for the Young's modulus of the material of the spacer member 90 and the substrate 92 to be 3 GPa or lower.

Furthermore, if the pressing force is 10 MPa, and the substrate 92 and the spacer member 90 are made of the same material and have a total thickness of 2 mm, then in order to achieve the maximum distortion of approximately 7.5 μm, and Young's modulus of the material of the spacer member 90 and the substrate 92 is required to be 2.7 GPa or greater.

Furthermore, if the spacer member 90 and the substrate 92 are made of different materials, then it is necessary for the spacer member 90 to have a smaller Young's modulus than that of the substrate 92, in other words, the spacer member 90 is required to be softer than the substrate 92.

More specifically, if the spacer member 90 and the substrate 92 are made of different materials, and if the pressing force is 3 MPa and the thickness of the spacer member 90 is taken to be 100 μm, then in order to generate a distortion of approximately 2 μm so as to be able to compensate the variation in the thickness of the piezoelectric body 58, it is necessary for the Young's modulus of the material of the spacer member 90 to be 500 MPa or less.

Furthermore, similarly to the above, if the spacer member 90 and the substrate 92 are made of different materials, and if the pressing force is 10 MPa and the thickness of the spacer member 90 is taken to be 100 μm, then in order to achieve the maximum distortion of approximately 7.5 μm, the Young's modulus of the material of the spacer member 90 is required to be 133 MPa or above.

FIG. 10 shows a table containing a summary of the information given above. In other words, if the spacer member 90 and the substrate 92 are made of the same material, then desirably, the Young's modulus is equal to or greater than 2.7 GPa and equal to or less than 3 GPa. Furthermore, if the spacer member 90 and the substrate 92 are made of different materials, then desirably, the Young's modulus of the material of the spacer member 90 is equal to or greater than 133 MPa and equal to or less than 500 MPa.

With regard to materials which match these ranges, a material such as hard rubber is suitable for the Young's modulus range of 133 MPa to 500 MPa, for instance, and a material such as polyimide is suitable for the Young's modulus range of 2.7 GPa to 3 GPa.

From the foregoing consideration, it can be seen that the following condition is established in respect of the material of the spacer member 90. In other words, taking the thickness of the material of the spacer member 90 to be L, the range of distortion of the spacer member 90 to be 2 to 7.5, the pressing force to be σ, and the Young's modulus of the material to be E, then the following condition formula (1) is established:

$$2/L<\sigma/E<7.5/L. \quad (1)$$

Furthermore, to generalize this formula (1) yet further, if the pressing force during connection comes within the range between the minimum value $\sigma_{min}$ and the maximum value $\sigma_{max}$, and if the thickness of the spacer member 90 is L, and the amount of compressive deformation of the spacer member 90 is in the range between $\delta L_{min}$ and $\delta L_{max}$, then the Young's modulus E of the spacer member 90 satisfies the following inequality formula (2):

$$\sigma_{min}\times L/\delta L_{min}\leqq E\leqq\sigma_{max}\times L/\delta L_{max}. \quad (2)$$

The range of the pressing force during connection described here is thought generally to be a range of 0.5 MPa to 50 MPa, as stated above, and furthermore, the values of the amount of compressive deformation can be taken as $\delta L_{min}=1$ μm, and $\delta L_{max}=15$ μm. In this case, the formula (2) becomes the following formula (3):

$$0.5\times L\leqq E\leqq 50\times L/15. \quad (3)$$

More specific embodiments are described below.

Figure 11:
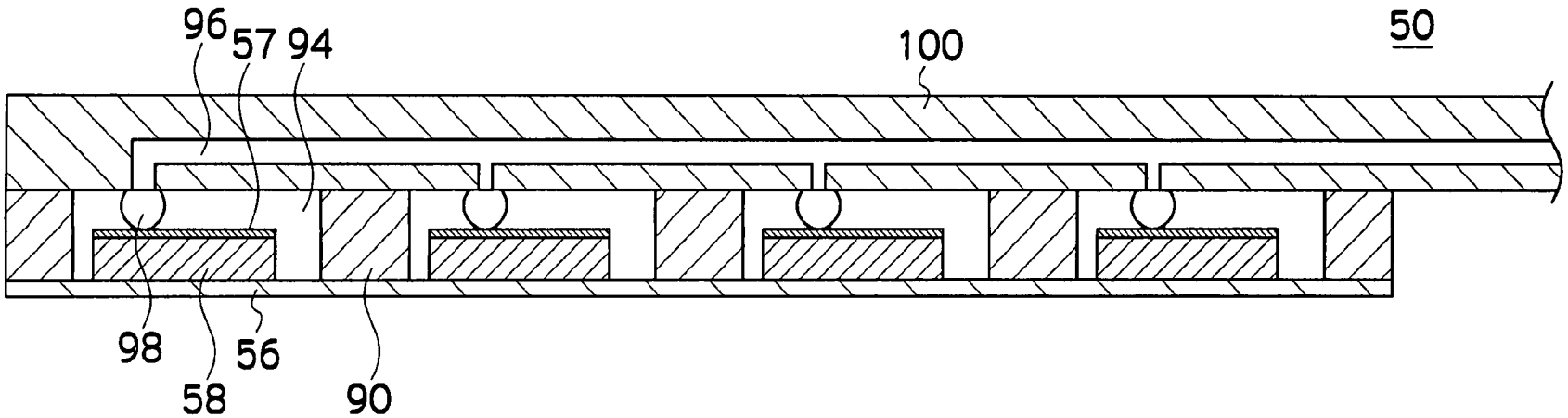
FIG. 11 is a cross-sectional diagram showing an enlarged view of electrical connection sections in the print head according to a first embodiment.

FIG. 11 is a cross-sectional diagram showing the state of substrate bonding in the print head 50 relating to a first embodiment. Similarly to FIG. 7, FIG. 11 shows the portion from the diaphragm upward. In the first embodiment shown in FIG. 11, the electrodes of a flexible cable (FPC) are connected directly to the individual electrodes of the piezoelectric bodies, via. conductive members.

As shown in FIG. 11, resin spacer members 90 are sandwiched between the diaphragm 56 and the flexible cable (FPC) 100, in order to create spaces 94 which prevent constriction of the driving of the piezoelectric bodies 58. These spacer members 90 are made of a material having a Young's modulus which is the same as, or lower than, whichever is lower of the Young's modulus of the flexible cable 100 and the Young's modulus of the diaphragm 56.

An electrical connection member 98 is formed on top of each individual electrode 57 on a piezoelectric body 58, these members serve to provide an electrical connection between the wires 96 of the flexible cable 100 and the individual electrodes 57, and the flexible cable 100 is bonded to the spacer members 90. In this case, bumps (electrode bumps)

may also be sandwiched between the individual electrodes 57 and the electrical connection members 98.

As described above, by appropriately setting the Young's modulus of the material of the spacer members 90, it is possible to make the resin spacer members 90 deform due to the pressing force applied when the flexible cable 100 is bonded to the spacer members 90 and individual electrodes 57 or is electrically connected to same, and hence the spacer members 90 compensate height variations in the piezoelectric bodies 58 and height variations in the electrode bumps, and the like, and consequently reliable bonding is achieved.

Furthermore, since the spacer members 90 are made of a soft resin material in this way, then due to the deformation of the resin spacer members 90, it is possible to alleviate stress caused by the difference in thermal expansion between the diaphragm 56 and the flexible cable 100. Furthermore, instead of the flexible cable 100, it is also possible to use a laminated substrate forming an interposer (a build-up substrate equipped with an IC).

Next, a second embodiment of substrate bonding of the print head is described below.

The present embodiment relates to substrate bonding in a case where the wires from the individual electrodes to the upper substrate are formed as columns which rise up perpendicularly with respect to the surface on which the piezoelectric bodies are formed.

Firstly, these column-shaped perpendicular wires (also called "electrical columns") are described below.

In the present embodiment, the electrical wires supplying drive signals to the individual electrodes corresponding to the piezoelectric bodies which cause deformation of the pressure chambers, rise up perpendicularly from the individual electrodes and are connected to the wires of a substrate, such as a flexible cable, in an upper position. Consequently, it is possible to increase the density of the electrical wires.

Figure 12:
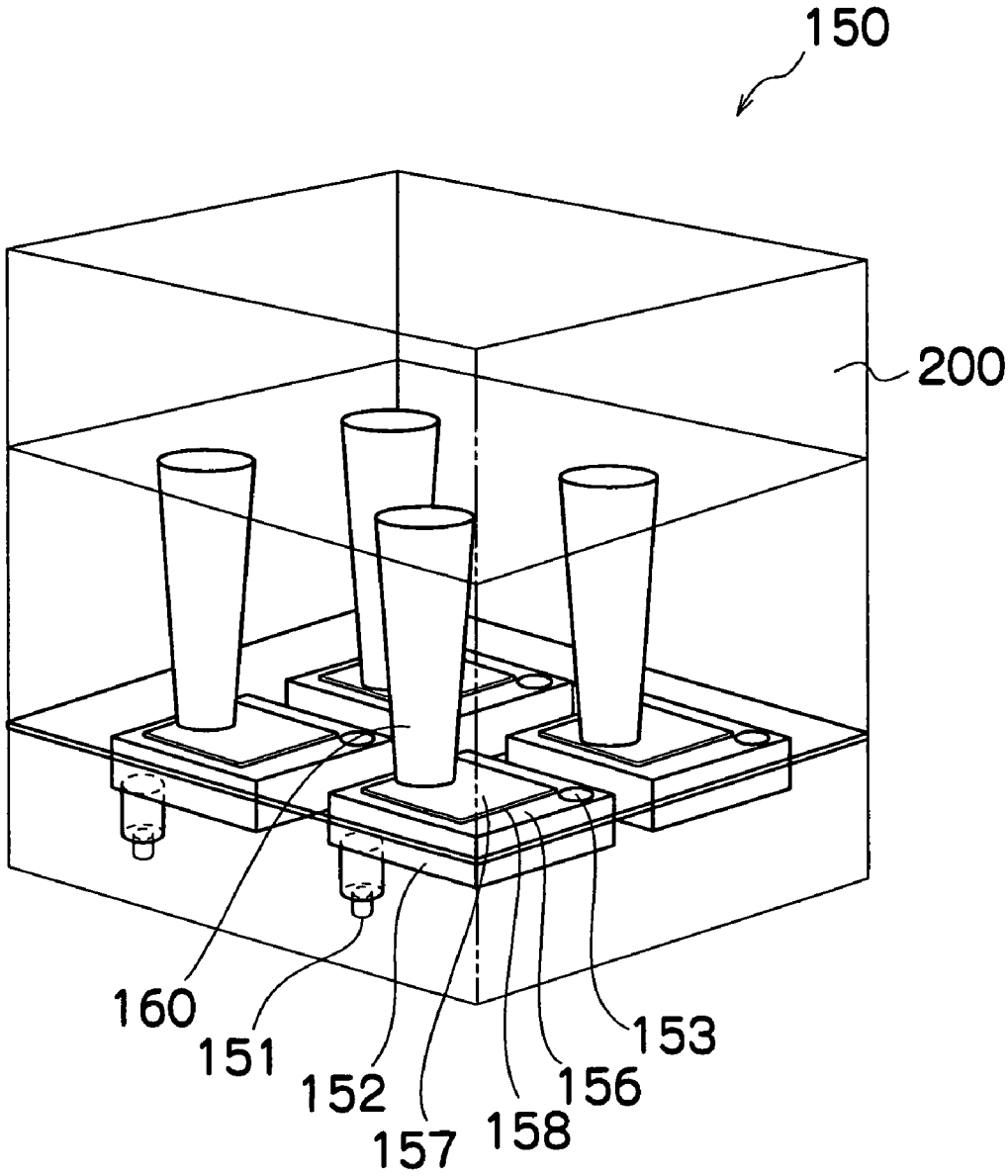
FIG. 12 is a perspective diagram showing an enlarged view of pressure chamber units in the print head according to a second embodiment.

FIG. 12 shows a simplified oblique perspective view of one portion of a print head in which the wires rise up perpendicularly in this fashion.

As shown in FIG. 12, in the print head 150 according to the present embodiment, a diaphragm 156 forming the upper surface of pressure chambers 152 is arranged on the upper side of the pressure chambers 152, each of which has a nozzle 151 and an ink supply port 153, and piezoelectric bodies 158 are formed on the diaphragm 156 in regions corresponding to the pressure chambers 152. An individual electrode 157 is formed on the upper surface of each piezoelectric body 158. Furthermore, the diaphragm 156 also serves as a common electrode.

Electrical wires 160 rise up from electrical connection sections on the individual electrodes 157, substantially perpendicularly to the surface on which the piezoelectric bodies 158 are formed, thus forming column-shaped wires (electrical columns). A multiple-layer flexible cable 200 is disposed on top of the electrical wires 160 formed in these column shapes, and drive signals are supplied to the individual electrodes 157 corresponding to the piezoelectric bodies 158 via these wires.

Furthermore, the space formed by the sequence of erected column-shaped electrical wires 160 between the diaphragm 156 and the flexible cable 200 is formed into a common liquid chamber 155 for supplying ink to the pressure chambers 152 via the ink supply ports 153.

The electrical wires 160 which each perpendicularly rise up in the form of a column from an individual electrode 157 at each pressure chamber 152 support the flexible cable 200 from below, thus creating the space which forms the common liquid chamber 155. In other words, the electrical wires 160 (electrical columns) are formed so as to pass through the common liquid chamber 155.

The electrical wires 160 shown here are formed independently with respect to each of the individual electrodes 157 corresponding to the piezoelectric bodies 158, in a one-to-one correspondence; however, in order to reduce the number of wires (the number of electrical columns), it is also possible to make one electrical wire 160 correspond to a plurality of piezoelectric bodies 158, in such a manner that the wires corresponding to several piezoelectric bodies 158 are gathered together and formed into one electrical wire 160. In addition to the wires connected to the individual electrodes 157, the wiring to the common electrode (diaphragms 156) may also be formed as this electrical wire(s) 160.

As shown in FIG. 12, a nozzle 151 is formed in the bottom surface of each pressure chamber 152, and an ink supply port 153 is provided in the upper surface of the pressure chamber 152, in a corner section which is symmetrical with respect to the nozzle 151. The ink supply ports 153 are pierced through the diaphragm 156, and the upper-positioned common liquid chamber 155 and the pressure chambers 152 are connected directly by means of the ink supply ports 153.

The diaphragm 156 is formed as a single plate which is common to all of the pressure chambers 152. Piezoelectric bodies 158 for deforming the pressure chambers 152 are disposed on the diaphragm 156 in positions corresponding to the pressure chambers 152. Electrodes (a common electrode and an individual electrode) for driving each piezoelectric body 158 by applying a voltage to same are formed on the upper and lower surfaces of each piezoelectric body 158, and consequently each piezoelectric body 158 is sandwiched between the electrodes.

As stated previously, the electrical wires (electrical columns) 160 are formed so as to rise up perpendicularly from the individual electrodes 157 and pass through the common liquid chamber 155.

A multi-layer flexible cable 200 is formed on top of the column-shaped electrical wires 160, in such a manner that the multi-layer flexible cable 200 is supported by the pillars formed by the electrical wires 160. The space forming the common liquid chamber 155 is formed by taking the diaphragm 156 as the base, and the multi-layer flexible cable 200 as the ceiling. Although not shown in the drawings, the individual electrodes 157 are each connected independently to each electrical wire 160, drive signals are supplied respectively to the individual electrodes 157, and thereby the piezoelectric bodies 158 are driven.

Furthermore, although not shown in FIG. 12, since the common liquid chamber 155 is filled with ink, the surfaces of the diaphragm forming the common electrode 156, the individual electrodes 157, the electrical wires 160 and the multi-layer flexible cable 200 which make contact with the ink are covered respectively with insulating protective films.

There are no particular restrictions on the dimensions of the print head 150 described above. To give one embodiment, the planar shape of each pressure chamber 152 is an approximately square shape of 300 μm×300 μm (the corners thereof being curved in order to prevent stagnation locations in the ink flow), and the height of the pressure chambers 152 is 150 μm, the diaphragm 156 and the piezoelectric bodies 158 each have a thickness of 10 μm, each of the electrical wires 160 (electrical columns) has a diameter of 100 μm at the bonding section with each individual electrode 157, and a height of each electrical wire 160 is 500 μm.

Figure 13:
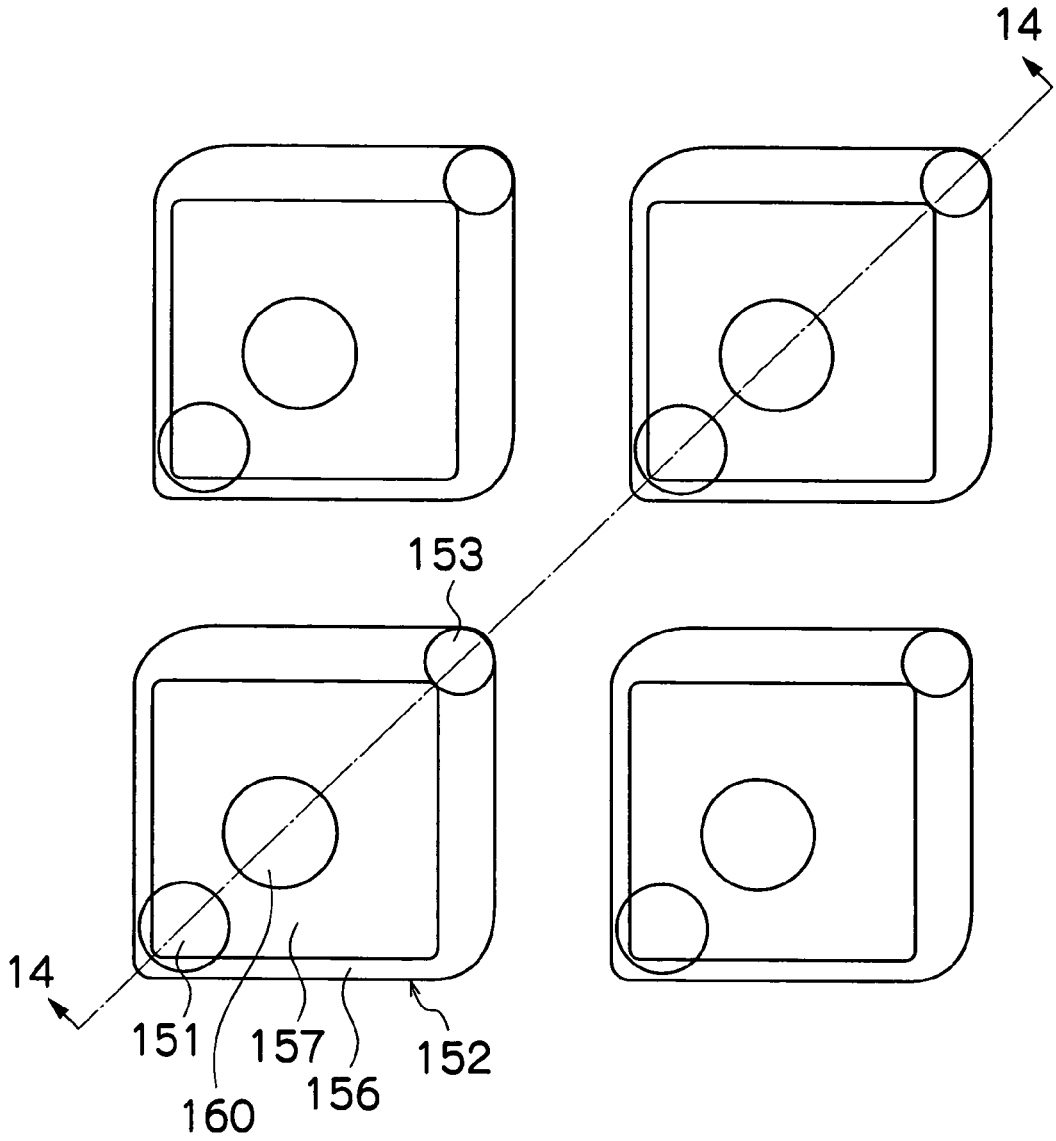
FIG. 13 is a plan view perspective diagram showing an enlarged view of a portion of pressure chambers.

FIG. 13 shows one portion of pressure chambers 152 of this kind, in an enlarged plan view perspective diagram. As stated previously, the pressure chambers 152 each have a substantially square shape, with a nozzle 151 and an ink supply port 153 formed in respective corners on a diagonal of the square shape. An electrical connection section is formed on each individual electrode 157, and an electrical wire (electrical column) 160 is formed on top of each electrical connection section.

Figure 14:
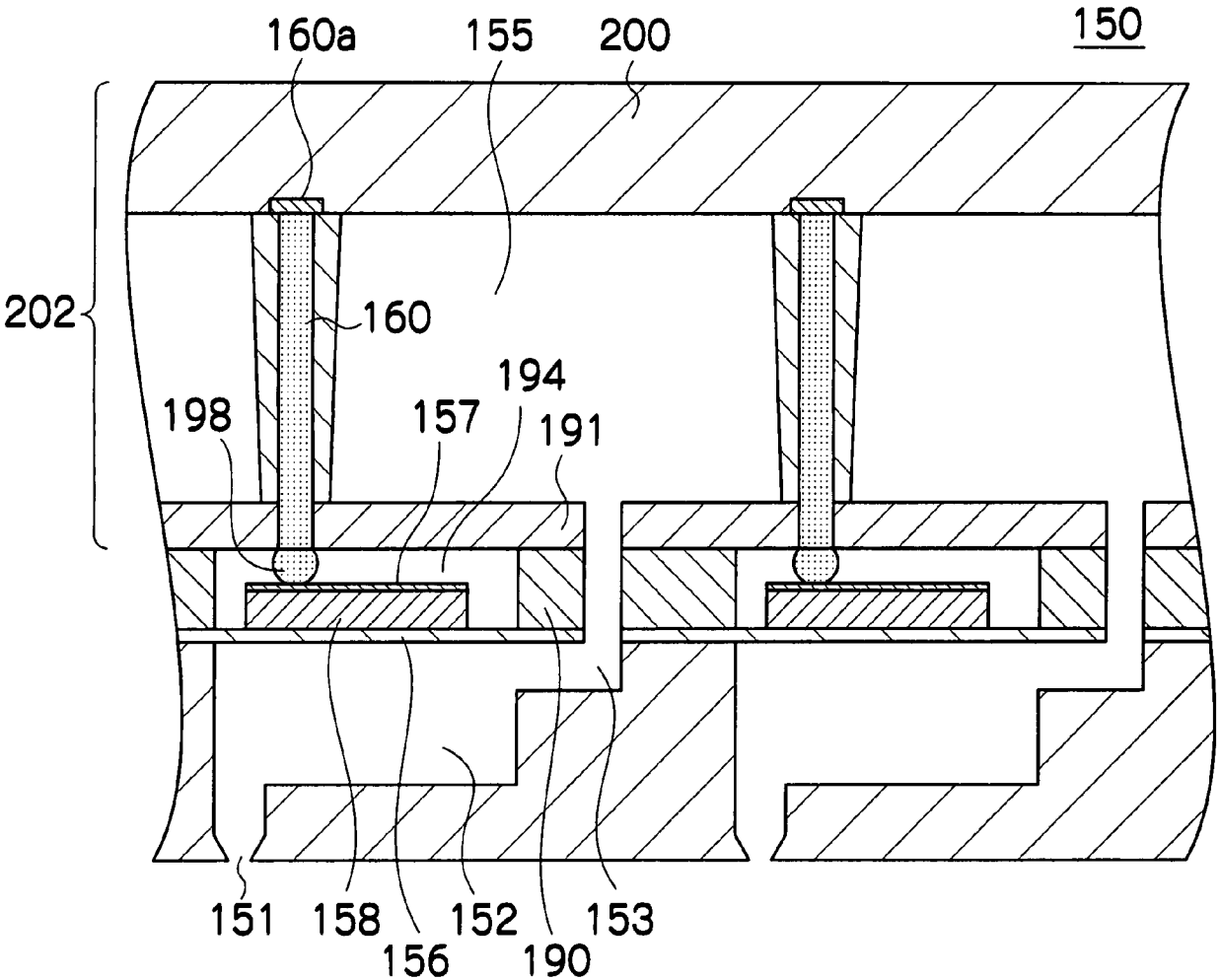
FIG. 14 is a cross-sectional diagram along line 14-14 in FIG. 13.

FIG. 14 is a cross-sectional diagram along line 14-14 in FIG. 13.

As shown in FIG. 14, the print head 150 according to the present embodiment comprises, pressure chambers 152 formed with nozzles 151, ink supply ports 153 which supply ink to the pressure chambers 152, a diaphragm 156 which forms the ceiling of the pressure chambers 152, piezoelectric bodies 158 and individual electrodes 157 formed on the diaphragm 156, and the like.

Opening sections corresponding to the ink supply ports 153 of the pressure chambers 152 are provided in the diaphragm 156, and thus the pressure chambers 152 are directly connected with the common liquid chamber 155 formed on the upper side of the diaphragm 156.

Each of the piezoelectric bodies 158 formed on top of the diaphragm 156 (common electrode) is sandwiched from above and below between the common electrode (diaphragm 156) and each individual electrode 157, and they constitute pressure generating elements. When a voltage is applied between the common electrode 156 and the individual electrode 157 with respect to each piezoelectric body 158, the piezoelectric body 158 deforms, thereby decreasing the volume of the pressure chamber 152 and causing ink to be ejected from the corresponding nozzle 151.

Furthermore, spaces 194 are formed about the perimeter of the piezoelectric bodies 158, by spacer members 190 and lid members 191, in such a manner that the piezoelectric bodies 158 are freely driven and are not constricted. Although there are no particular restrictions on the material of the lid members 191, desirably, for example, ceramic is used. Moreover, column-shaped electrical wires (electrical columns) 160 are formed on top of the individual electrodes 157 via electrical connection members 198, substantially perpendicularly to the surface where the piezoelectric bodies 158 are formed, so as to pass through the lid members 191 and the common liquid chamber 155.

A multi-layer flexible cable 200 is formed on top of the electrical wires 160, and wires (not shown) formed in the multi-layer flexible cable 200 are connected via the electrode pads 160*a* to the respective electrical wires 160, in such a manner that drive signals for driving the piezoelectric bodies 158 can be supplied via the electrical wires 160.

Furthermore, the space in which the column-shaped electrical wires (electrical columns) 160 are erected between the diaphragm 156 and the multi-layer flexible cable 200 forms a common liquid chamber 155 in which ink for supplying to the pressure chambers 152 is accumulated. Since this space is filled with ink, the surface portions of the diaphragm 156, the individual electrodes 157, the piezoelectric bodies 158, the electrical wires 160 and the multi-layer flexible cable 200 which make contact with the ink, are covered with insulating/protective films (not shown).

In this way, the structure above the piezoelectric bodies 158, including the common liquid chamber 155 formed by the lid members 191, the electrical wires 160 and the multi-layer flexible cable 200, constitutes a rear surface flow channel unit 202.

In this way, in the present embodiment, the common liquid chamber, which is situated on the same side of the diaphragm as the pressure chambers in many cases, is transferred to the upper side (rear surface) of the diaphragm, and hence is disposed on the opposite side to the pressure chambers. Therefore, in contrast to the related art, no piping, or the like, is required to conduct the ink from the common liquid chamber to the pressure chambers. Furthermore, since the size of the common liquid chamber can be increased, the ink can be reliably supplied, high nozzle density can be achieved, and driving at high frequency can be performed even when the nozzles are arranged at high density.

Furthermore, since the wiring to the individual electrodes of the piezoelectric bodies rises up perpendicularly from the individual electrodes, then it is possible to increase the density of the wiring used to supply drive signals to the piezoelectric bodies.

Furthermore, since the common liquid chamber is positioned on the upper side of the diaphragm in such a manner that the common liquid chamber and pressure chambers are connected by means of the direct (straight) ink supply ports, it is possible to provide a direct fluid connection between the common liquid chamber and the pressure chambers. Moreover, since the common liquid chamber is positioned on the upper side of the diaphragm, it is possible to reduce the length of the nozzle flow channels from the pressure chambers to the nozzles, in comparison with the related art. Furthermore, even if the nozzles are formed to a high density, it is still possible to eject ink of high viscosity (for example, approximately 20 cP to 50 cP) and a flow channel structure capable of swift refilling after ejection is achieved.

Figure 15:
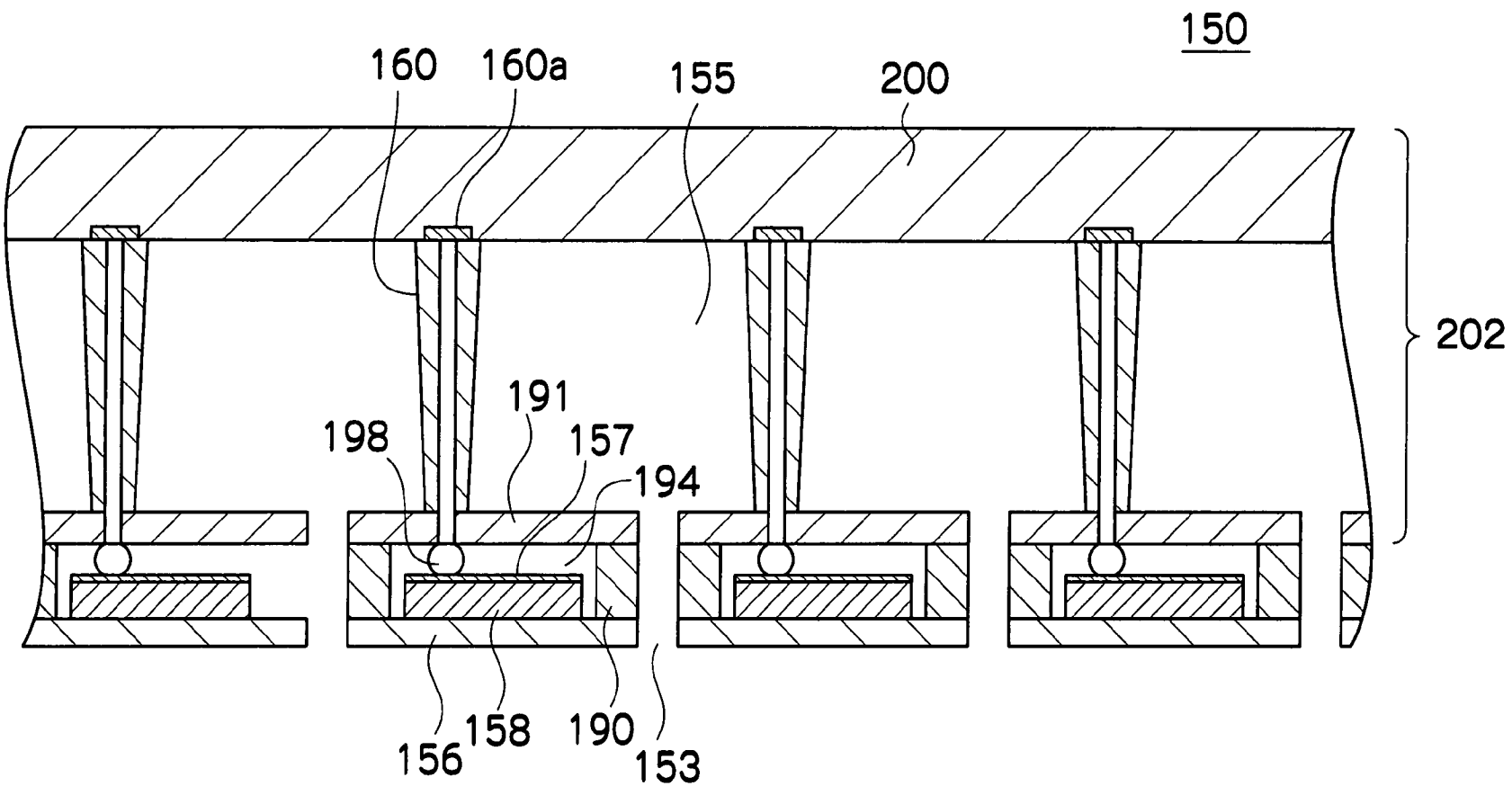
FIG. 15 is a cross-sectional diagram showing an enlarged view of electrical connection sections in the print head according to the second embodiment.

FIG. 15 is a cross-sectional diagram showing the state of substrate bonding in the print head 150 relating to a second embodiment. Similarly to FIG. 7, FIG. 15 shows the portion from the diaphragm upward.

In the second embodiment shown in FIG. 15, the electrodes of column-shaped wires, formed in each rear-surface flow channel unit which comprises a common liquid chamber formed on the upper side of the pressure chambers, are connected directly to the individual electrodes on the piezoelectric bodies, via conducting members.

As shown in FIG. 15, each resin spacer member 190 is sandwiched between the diaphragm 156 and the rear-surface flow channel unit 202, in order to create spaces 194 which prevent constriction of the driving of the piezoelectric bodies 158. These spacer members 190 are made of a soft material, and desirably, a material having a Young's modulus of 150 MPa to 3 GPa. More specifically, similarly to the first embodiment described above, a resin material or a rubber material is suitable for use as the spacer members 190.

An electrical connection member 198 is formed on top of an individual electrode 157 on each piezoelectric body 158. These electrical connection members 198 serve to provide electrical connections between the electrical wires 160 in the rear-surface flow channel unit 202 and the individual electrodes 157, and the rear-surface flow channel unit 202 is bonded to each spacer member 190. In this case, bumps (electrode bumps) may also be sandwiched between the individual electrodes 157 and the electrical connection members 198.

The resin spacer members 190 deform due to the pressure applied during the adhesion and electrical connection of the rear-surface flow channel unit 202 to the spacers members 190 and individual electrodes 157, and this deformation compensates and reduce the influence of height variations in the piezoelectric bodies 158 and height variations in the electrode bumps, and hence reliable bonding can be achieved.

Furthermore, due to the deformation of the resin spacer members 190, it is possible to alleviate stress caused by the difference in thermal expansion between the diaphragm 156 and the rear-surface flow channel unit 202.

As described above, according to each of the embodiments of the present invention, spacer members for creating spaces which prevent constriction of the driving of the piezoelectric bodies are made of a soft material, and therefore, height variations in the piezoelectric bodies and electrodes can be compensated during connection by the deformation of the spacer member, thus making it possible to achieve reliable bonding. Furthermore, since there is some freedom with respect to differences in thermal expansion, it is possible to alleviate stress.

The liquid ejection head according to the present invention has been described in detail above, but the present invention is not limited to the aforementioned embodiments, and it is of course possible for improvements or modifications of various kinds to be implemented, within a range which does not deviate from the essence of the present invention.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid ejection head, comprising:

a nozzle through which liquid is ejected;

a pressure chamber which contains the liquid and connects to the nozzle;

a piezoelectric body which changes volume of the pressure chamber to generate pressure for ejecting the liquid in the pressure chamber through the nozzle;

a spacer member which forms a space allowing the piezoelectric body to be displaced; and an electrical connection member which connects the piezoelectric body with a substrate having a wire, the electrical connection member being provided inside the space, wherein the following formula is satisfied:

$$\sigma_{min} \times L/\delta L_{min} \leqq E \leqq \sigma_{max} \times L/\delta L_{max},$$

where a range from $\sigma_{min}$ through $\sigma_{max}$ represents a range of a pressing force when the piezoelectric body and the substrate is connected via the electrical connection member, L represents a thickness of the spacer member, a range from $\delta L_{min}$ through $\delta L_{max}$ represents a range of an amount of compressive deformation of the spacer member when the pressing force is applied within the range of the pressing force, and E represents a Young's modulus of the spacer member, wherein $\sigma_{min}$ is 0.5 MPa, $\sigma_{max}$ is 50 MPa, $\delta L_{min}$ is 1 μm, and $\delta L_{max}$ is 15 μm.

2. The liquid ejection head as defined in claim 1, wherein the spacer member is made from a resin material.

3. The liquid ejection head as defined in claim 1, wherein the spacer member is made from a rubber material.

4. The liquid ejection head as defined in claim 1, wherein the spacer member and the substrate are made from a same material,

5. The liquid ejection head as defined in claim 1, wherein:

the spacer member and the substrate are made of different materials; and the Young's modulus of the spacer member is lower than a Young's modulus of the substrate.

6. The liquid ejection head as defined in claim 1, further comprising an electrical wire which supplies a drive signal for driving the piezoelectric body, the electrical wire being formed so as to rise upward substantially perpendicularly to a surface on which the piezoelectric body is formed.

7. The liquid ejection head as defined in claim 1, wherein the electrical connection member is made from solder.

8. The liquid ejection head as defined in claim 1, wherein the electrical connection member is made from conductive adhesive.

9. The liquid ejection head as defined in claim 1, wherein the electrical connection member has fluidity.

10. The liquid ejection head as defined in claim 1, wherein the electrical connection member is arranged between the piezoelectric body and the wire.

11. The liquid ejection head as defined in claim 1, wherein the spacer member is arranged to each of lateral sides of the piezoelectric body.

12. The liquid ejection head as defined in claim 1, wherein the spacer member is arranged between the substrate and a diaphragm to which the piezoelectric body is bonded.

13. The liquid ejection head as defined in claim 1, wherein the spacer member is in contact with the substrate and a diaphragm to which the piezoelectric body is bonded.

14. A liquid ejection head, comprising:

a piezoelectric body;

spacer portions of uncompressed thickness L formed on at least two opposite sides of the piezoelectric body, the spacer portions of uncompressed thickness L being dimensioned to provide a space between an electrode on the piezoelectric body and an opposing surface of the substrate so that the piezoelectric body and the electrode can be displaced in said space relative to the opposing surface of the substrate even when the spacer portions are compressed by a force in a range from a minimum force $\sigma_{min}$ to a maximum force $\sigma_{max}$, the material forming the spacer portions having a Young's modulus E; and an electrical connection member that provides a connection between a wire associated with the substrate and the electrode on the piezoelectric body inside the space when the electrical connection member is pressed between the electrode on the piezoelectric body and the opposing surface of the substrate with the force in the range from $\sigma_{min}$ to $\sigma_{max}$ with the spacer portions of uncompressed thickness L being correspondingly compressively deformed in a range from $\delta L_{min}$ corresponding to $\sigma_{min}$ to $\delta L_{max}$ corresponding to $\sigma_{max}$, and the formula $\sigma_{min} \times L/\delta L_{min} \leqq E \leqq \sigma_{max} \times L/\delta L_{max}$ is satisfied, wherein the electrical connection member has fluidity so that the electrical connection member does not transmit force when being pressed between the electrode on the piezoelectric body and the opposing surface of the substrate to make the connection between the wire associated with the substrate and the electrode on the piezoelectric body.

15. The liquid ejection head as defined in claim 14, wherein $\sigma_{min}$ is 0.5 MPa, $\sigma_{max}$ is 50 MPa, $\delta L_{min}$ is 1 μm, and $\delta L_{max}$ is 15 μm.

16. The liquid ejection head as defined in claim 14, wherein the spacer portions are made from a resin material.

17. The liquid ejection head as defined in claim 14, wherein the spacer portions are made from a rubber material.

18. The liquid ejection head as defined in claim 14, wherein the spacer portions and the substrate are made from a same material.

19. The liquid ejection head as defined in claim 14, wherein:

the spacer portions and the substrate are made of different materials; and the Young's modulus of the spacer portions are lower than a Young's modulus of the substrate.

20. The liquid ejection head as defined in claim 14, wherein the wire supplies a drive signal for driving the piezoelectric body and the electrode so that they are displaced in said space, the wire being formed so as to be substantially perpendicular to a diaphragm on which the piezoelectric body is formed.

* * * * *